US005617070A

United States Patent [19]

Bodnar

[11] Patent Number: 5,617,070

[45] Date of Patent: Apr. 1, 1997

[54] GAS/ELECTRIC OVEN THERMOSTAT WITH SELF CLEANING TEMPERATURE CALIBRATION MECHANISM

[75] Inventor: Michael Bodnar, West Chicago, Ill.

[73] Assignee: Harper-Wyman Company, Aurora, Ill.

[21] Appl. No.: 435,811

[22] Filed: May 5, 1995

[51] Int. Cl.[6] ..... H01H 37/12

[52] U.S. Cl. ..... 337/323; 337/319

[58] Field of Search ..... 337/309, 337, 337/323, 319, 101, 53

[56] References Cited

U.S. PATENT DOCUMENTS

| | | | |
|---|---|---|---|
| 3,065,323 | 11/1962 | Grimshaw . | |
| 3,197,595 | 7/1965 | Weber . | |
| 3,274,362 | 9/1966 | Frendock . | |
| 3,293,394 | 12/1966 | Staples . | |
| 3,304,395 | 2/1967 | Slonneger . | |
| 3,386,064 | 5/1968 | Russell . | |
| 3,423,021 | 1/1969 | Bergquist . | |
| 3,617,972 | 11/1971 | Branson . | |
| 3,668,592 | 6/1972 | Decker . | |
| 3,766,905 | 10/1973 | Sekera, Jr. . | |
| 3,986,409 | 10/1976 | Tripp et al. . | |
| 4,052,591 | 10/1977 | Sekera, Jr. et al. . | |
| 4,194,102 | 3/1980 | Branson et al. . | |
| 4,710,742 | 12/1987 | Cors et al. . | |
| 4,751,491 | 6/1988 | Cors et al. . | |
| 4,973,933 | 11/1990 | Kadlubowski . | |
| 4,990,728 | 2/1991 | Joyce . | |
| 5,025,242 | 6/1991 | Holtkamp et al. | 337/309 |
| 5,101,189 | 3/1992 | Dolza et al. . | |
| 5,311,165 | 5/1994 | Kadlubowski | 337/323 |

*Primary Examiner*—Leo P. Picard
*Assistant Examiner*—Jayprakash N. Gandhi
*Attorney, Agent, or Firm*—Mason, Kolehmainen, Rathburn & Wyss

[57] ABSTRACT

A thermostat for an electric/gas oven includes a first electrical contact, a second electrical contact, a switch spring arm for moving the electrical contacts into and out of engagement and a pair of actuators for coupling forces to the switch spring arm. An enclosure encloses the switch spring arm and the first and second electrical contacts. The enclosure has axially aligned channels extending through opposed walls for slidably receiving the actuators. A temperature responsive subassembly includes a mechanism for movement responsive to changes in oven temperature and a spindle subassembly including mechanism for movement responsive to manual rotation of a spindle. A frame supports the enclosure and supports both the temperature responsive subassembly and the spindle subassembly in operative position with respect to the actuators. A self cleaning temperature calibration mechanism selectively determines a self cleaning oven temperature setting. The self cleaning temperature calibration mechanism comprises cooperating members coupled to the spindle and the enclosure to limit rotation of the spindle and accurately determine the self cleaning oven temperature.

11 Claims, 5 Drawing Sheets

FIG. 1
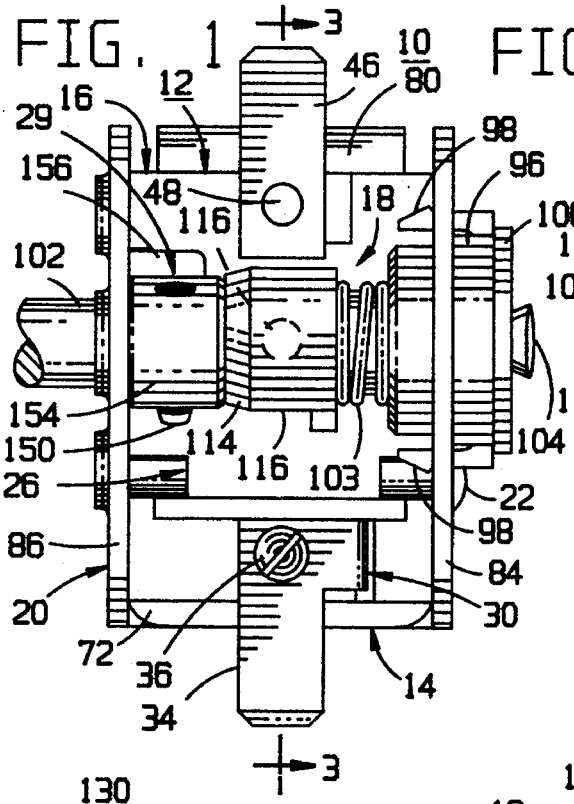
FIG. 2
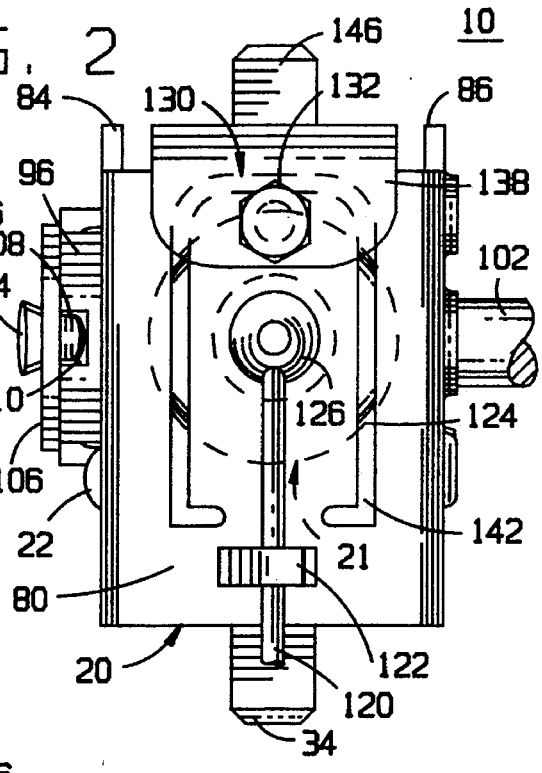
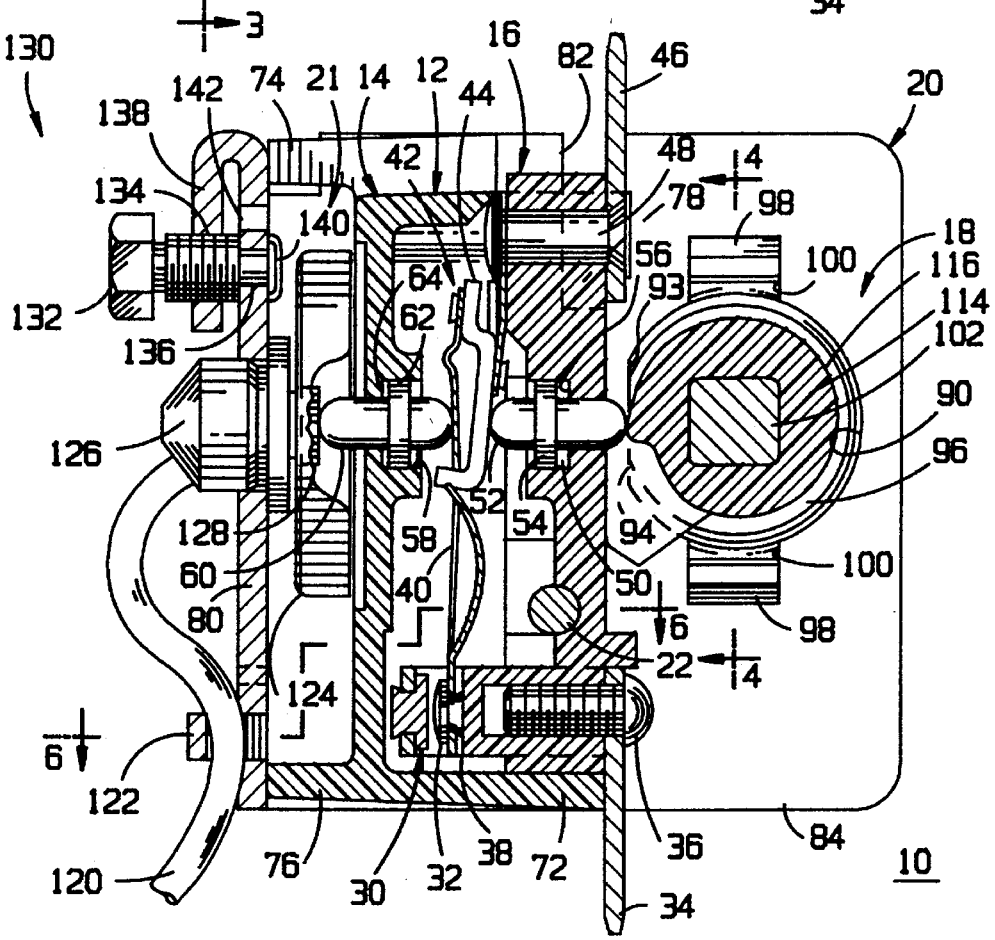
FIG. 3

14
16
70
66
68
71
74
46
48
78
52
26
160
156
158
50
76
12
72
34
36
10
142
138
82
20
100
21
124
128
80
122
120
86
148
93
90
92
24
28
84
18
103
98
106
96
114
152
29
102
154
116
22

GAS/ELECTRIC OVEN THERMOSTAT WITH SELF CLEANING TEMPERATURE CALIBRATION MECHANISM

FIELD OF THE INVENTION

The present invention relates generally to a thermostat, and more particularly to a thermostat for controlling the temperature in an oven of an electric or gas stove.

DESCRIPTION OF THE PRIOR ART

Various generally satisfactory arrangements are known in the art for controlling temperature in an oven. U.S. Pat. Nos. 4,710,742 and 4,751,491, assigned to the assignee of the present invention, disclose improved electric/gas oven thermostats including first and second electrical contacts and an actuating assembly including an actuating spring arm for opening and closing an electrical path between the contacts. An actuating snap spring includes the actuating spring arm positioned for movement responsive to both a manually operable mechanism and a temperature responsive mechanism. The manually operable mechanism is movable to an OFF position and a plurality of ON positions for selecting an oven operating temperature. The temperature responsive mechanism is movable in response to changes in oven temperature. The spring arm has a fixed end mechanically and electrically coupled to a first electrical contact by a movable support member and a free end that moves between a contacting position and a noncontacting position with the second electrical contact terminal. The movable support member enables a coaxial alignment of a pair of push rods or actuators moved by the manually operable mechanism and the temperature responsive mechanism. A calibration mechanism accurately determines the position of the actuating assembly relative to the temperature responsive mechanism.

U.S. Pat. No. 5,311,165, assigned to the assignee of the present invention, discloses an assembly method and a modular thermostat for an electric/gas oven. An enclosure formed by a base and a cover for enclosing a switch subassembly includes axially aligned channels extending through opposed walls and external keying and positioning features. A pair of axially aligned actuators are received within the axially aligned channels. A frame having cooperating keying and positioning features positions and supports the enclosure containing the switch subassembly and supports both a temperature responsive subassembly and a spindle subassembly in operative position with respect to the actuators.

While these thermostats provide improvements over many existing thermostats, it is desirable to provide an improved thermostat having a calibration mechanism to accurately determine a self cleaning temperature.

SUMMARY OF THE INVENTION

Among the principal objects of the present invention are to provide an electric/gas oven thermostat; to provide a new and improved thermostat that provides effective and reliable operation and includes a calibration mechanism to determine a self cleaning temperature; and to provide a thermostat overcoming one or more of the disadvantages of known thermostats.

In brief, the objects and advantages of the present invention are achieved by a thermostat for an electric/gas oven. The thermostat includes a first electrical contact, a second electrical contact, a switch spring arm for moving the electrical contacts into and out of engagement and a pair of actuators for coupling forces to the switch spring arm. An enclosure encloses the switch spring arm and the first and second electrical contacts. The enclosure has axially aligned channels extending through opposed walls for slidably receiving the actuators. A temperature responsive subassembly includes a mechanism for movement responsive to changes in oven temperature and a spindle subassembly including mechanism for movement responsive to manual rotation of a spindle. A frame supports the enclosure and supports both the temperature responsive subassembly and the spindle subassembly in operative position with respect to the actuators. A self cleaning temperature calibration mechanism selectively determines a self cleaning oven temperature setting. The self cleaning temperature calibration mechanism comprises cooperating members coupled to the spindle and the enclosure to limit rotation of the spindle and accurately determine the self cleaning oven temperature.

BRIEF DESCRIPTION OF THE DRAWINGS

The present invention together with the above and other objects and advantages may best be understood from the following detailed description of the preferred embodiments of the invention illustrated in the drawings, wherein:

FIG. 1 is a side elevational view of a thermostat constructed in accordance with the principles of the present invention;

FIG. 2 is an opposed side elevational view of the thermostat of FIG. 1;

FIG. 3 is an enlarged cross-sectional view taken along the line 3—3 of FIG. 1;

DETAILED DESCRIPTION OF THE PREFERRED EMBODIMENTS

Figure 4:
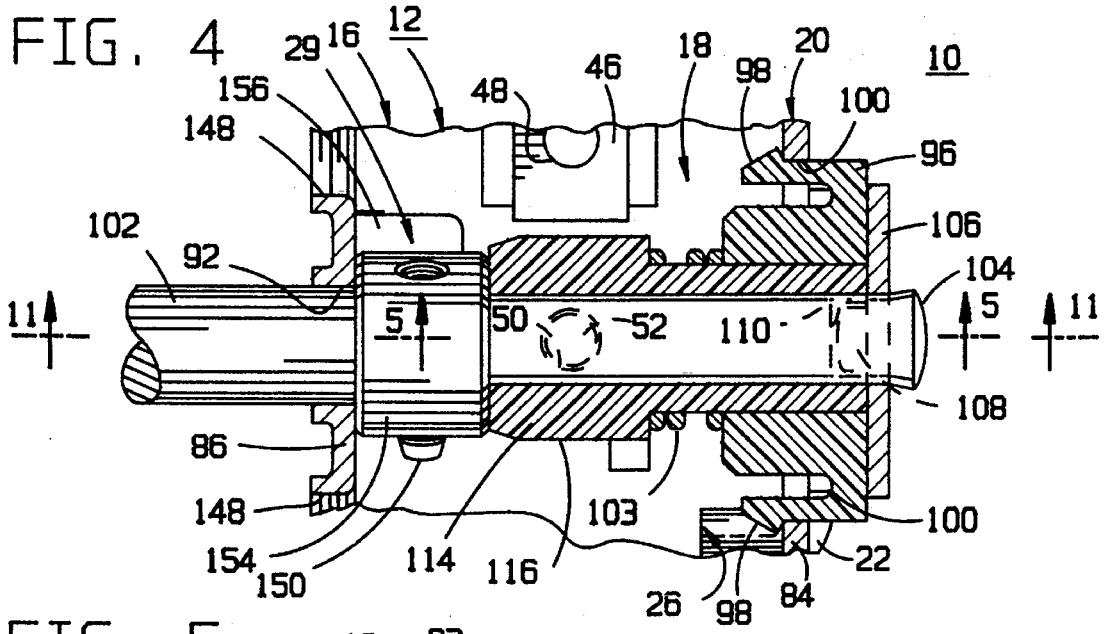
FIG. 4 is a fragmentary cross-sectional view taken along the line 4—4 of FIG. 3.
Figure 5:
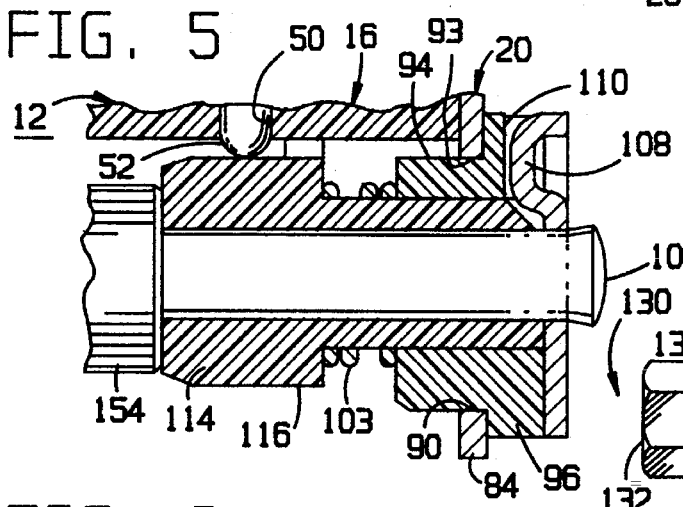
FIG. 5 is a fragmentary cross-sectional view taken along the line 5—5 of FIG. 4.
Figure 7:
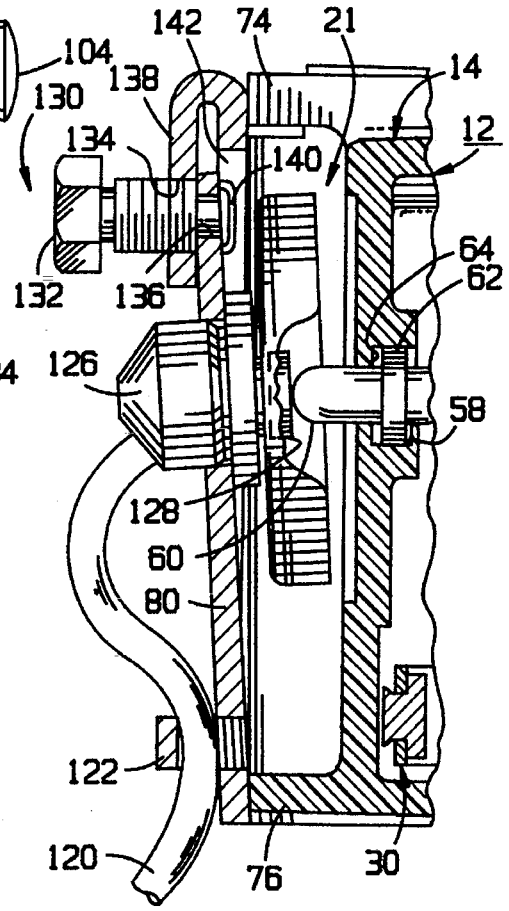
FIG. 7 is a fragmentary cross-sectional view similar to FIG. 3.
Figure 6:
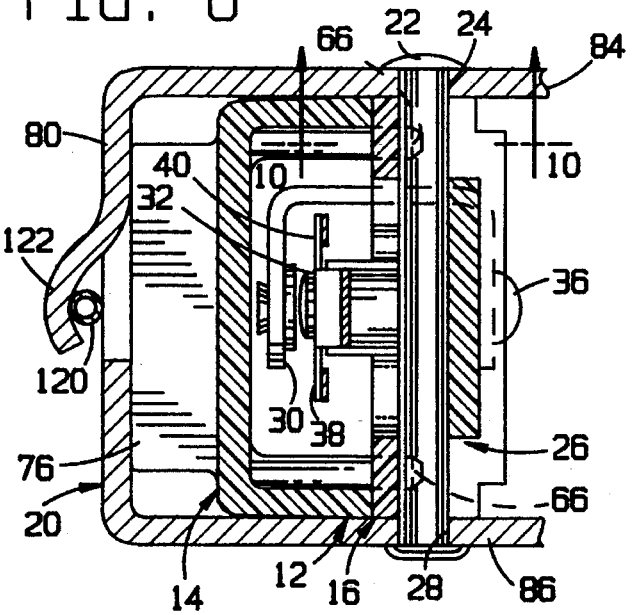
FIG. 6 is a cross-sectional view taken along the line 6—6 of FIG. 3.
Figures 8, 9, 10:
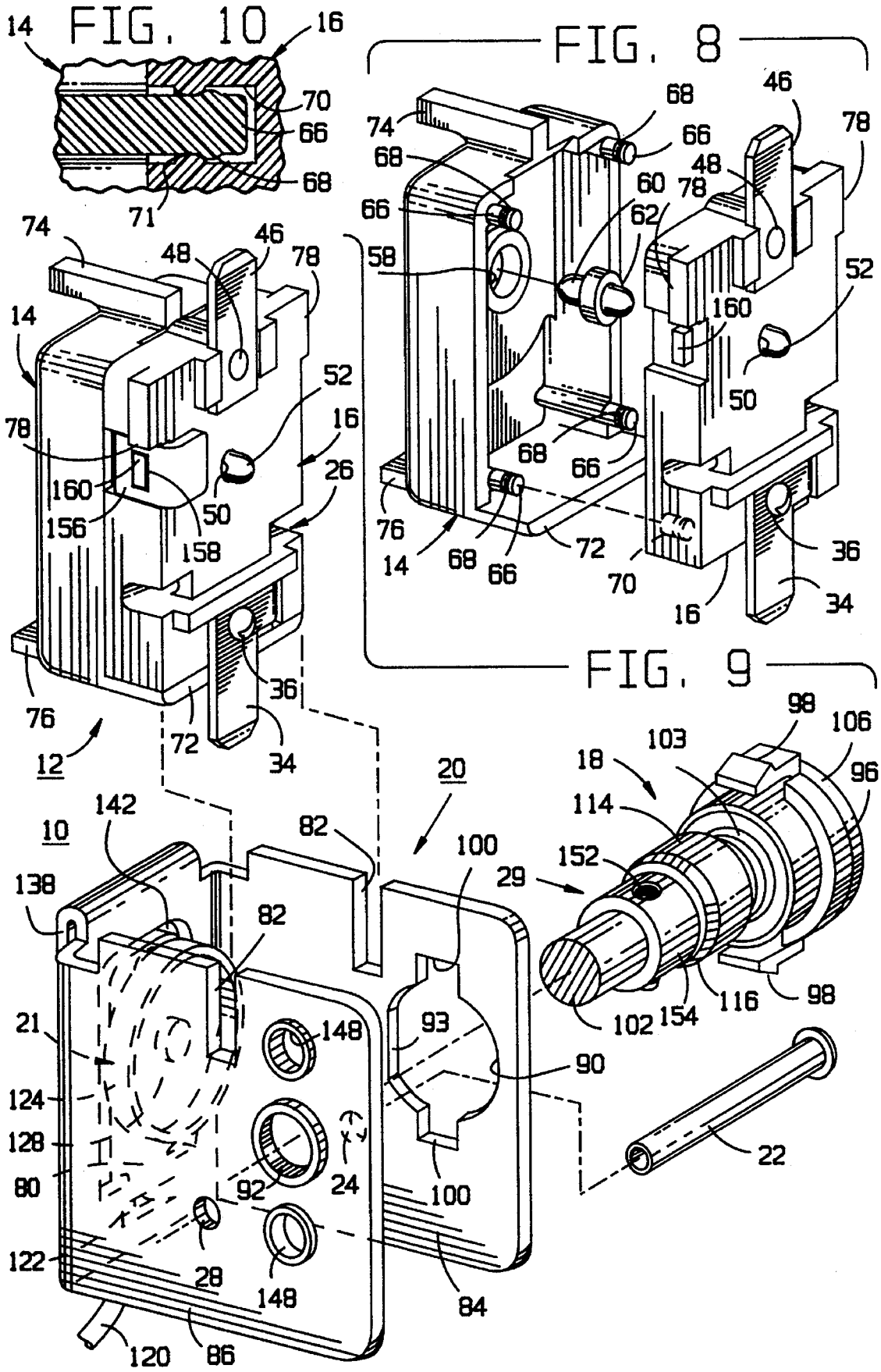
FIG. 8 is an exploded perspective view of a base subassembly and a cover subassembly of the thermostat of FIG. 1.
FIG. 9 is an exploded perspective view of the thermostat of FIG. 1.
FIG. 10 is a fragmentary cross-sectional view taken along the line 5—5 of FIG. 6.

Referring now to the drawings, in FIGS. 1–11 and 12A, 12B and 12C there is illustrated a modular electric/gas oven thermostat designated as a whole by the reference character 10 and arranged in accordance with principles of the present invention. Having reference initially to FIG. 9, an exploded perspective view of the thermostat 10 is shown. Thermostat 10 is a modular unit including an actuating snap-switch subassembly enclosure 12 formed by a cover 14 and a base 16, a spindle/cam subassembly 18, a switch frame 20 and a temperature responsive subassembly 21. As shown in FIG. 9, the actuating snap-switch subassembly enclosure 12 is first assembled, then the temperature responsive subassembly 21, the enclosure 12 and the spindle/cam subassembly 18 are mounted with the frame 20 to assemble the thermostat 10. A semi-tubular rivet 22 secures the enclosure 12 to the switch frame 20 received within a first frame aperture 24, an external housing channel 26 formed in the base 16 and a second frame aperture 28. A self cleaning temperature calibration mechanism generally designated by the reference character 29 is arranged in accordance with the invention for accurately determining a self cleaning temperature for the electric/gas oven.

Cover 14 and base 16 are formed of a rigid electrically insulating material, such as, of a synthetic plastic material, for example, by injection molding technique. Switch frame 20 is formed of sheet metal that is punched or stamped and then formed as shown.

Referring to FIGS. 1, 3, 6 and 8, the actuating snap-switch enclosure subassembly 12 provides reliable switching operation by accurately positioning and avoiding contamination of a pair of electrical contacts 30 and 32 within base 16. Contact 30 includes a terminal blade portion 34 extending outside the base 16 for electrical connection in conventional manner. Contact 30 is secured within the base by a fastener 36. Electrical contact 32 is carried by a lower free end 38 of an elongated spring arm 40 of a snap spring switch 42. Snap spring switch 42 includes an upper fixed end portion 44 connected to an external terminal blade portion 46 by a fastener 48.

U.S. Pat. No. 4,710,742 discloses a snap spring assembly for an electric/gas oven thermostat and is assigned to the present assignee. The disclosure of U.S. Pat. No. 4,710,742 is incorporated herein by reference. Snap spring switch 42 opens and closes an electrical path between the electrical contacts 30 and 32 for controlling the on-off condition of a heating element or control valve (not shown) of an oven of an electric or gas range to provide a selected oven temperature. Principles of the invention may be applied to thermostats of other types.

Referring also to FIG. 9, base 16 includes a channel 50 for receiving and positioning an actuator 52. Actuator 52 includes a collar 54 engaging a stop wall 56 formed by the base 16. Cover 14 similarly includes a channel 58 for receiving and positioning an actuator 60. Actuator 60 includes a collar 62 engaging a stop wall 64 formed by the cover 14. Cover 14 includes a plurality of posts 66 each having a rib or collar 68. Each post 66 with the collar 68 is received within a corresponding, complementary aligned aperture 70 with a rib portion 71 formed in base 16 as shown in FIG. 10. Cover 14, having the actuator 60 placed in the channel 58, is assembled in snap fit engagement with the base 16 having the actuator 52 placed in the channel 50 and the terminal blade portions 34 and 46, electrical contacts 30 and 32 and snap-switch 42 installed with the base. Actuators 52 and 60 are axially aligned and transmit forces to the snap spring switch 42 for moving the electrical contacts 30 and 32 into and out of engagement. Cover 14 includes a lower ledge 72 supporting the base 16 in the assembled condition of the actuating snap-switch enclosure subassembly 12.

Actuating snap-switch subassembly enclosure 12 includes an upper spacer 74 and a lower spacing ledge 76 formed by the cover 14 and a pair of opposed ears 78 formed by the base 16. Switch frame 20 is generally U-shaped with a center wall 80 for positioning engagement with the spacer 74 and lower spacing ledge 76 of enclosure 12. A pair of complementary slots 82 formed in a pair of opposed side walls 84 and 86 of the switch frame 20 receive and retain the opposed ears 78 of actuating snap-switch subassembly enclosure 12. The actuating snap-switch subassembly enclosure 12 is retained in the final assembled position with the frame 20 by the rivet 22.

Switch frame 20 includes a pair of aligned apertures 90 and 92 formed in the opposed side walls 84 and 86 for receiving and positioning the spindle/cam subassembly 18. Aperture 90 includes a flat surface 93 for cooperating with a flat wall portion 94 of a bushing 96 (FIG. 3) for positioning the spindle/cam subassembly 18. A pair of locking tabs 98 formed by the bushing 96 are received within aligned slots 100 of the switch frame 20 for retaining the spindle/cam subassembly 18 with the switch frame 20 in the final assembled position with a spindle stem shaft 102 extending through aperture 92. An end 104 is headed over to secure a detent washer 106 of spindle shaft 102 adjacent the bushing 96. A knob, (not shown), is carried by the spindle shaft 102 exterior of the switch frame 20 for manual rotation by a user-operator.

Spindle/cam subassembly 18 is push-to-rotate to avoid accidental operation of the thermostat 10. A detent 108 formed on the detent washer 106 is received within a stop channel 110 formed by the bushing 96 in the OFF position of the thermostat 10. Spindle 102 is rotated by applying sufficient axial force to the spindle shaft 102 to overcome the pressure exerted by a coiled spring 103 and to disengage the detent 108 from the bushing stop 110. A cam 114 is mounted on the spindle 102 for corresponding rotation with the spindle 102 responsive to the manual rotation of the knob. Cam 114 provides a cam surface 116 in operative engagement with the actuator 52 for controlling the cyclic on-off snap-switch position corresponding to a user selected temperature.

Referring to FIGS. 2, 3, 7 and 9, a temperature responsive subassembly 21 includes a capillary tube 120 that extends within the oven and carries a fluid that expands in proportion to increased oven temperature. A strain relief member 122 defined by switch frame 20 traps the capillary tube 120 and provides strain relief. This fluid expansion is accommodated by an expansible diaphragm or bellows 124 within the switch frame 20 and communicates with the capillary tube 120 by a coupling 126 and a nib 128. Expansion of the bellows 124 moves the nib 128 against actuator 60 to move the actuating spring arm 40 to open the electrical contact 30 and 32 for an oven temperature corresponding to a particular selected oven temperature.

A first calibration mechanism generally designated 130 includes a calibration screw 132 received through a pair of aligned apertures 134 and 136 within a tab portion 138 and the switch frame center wall 80. The calibration screw 132 is peened at an end 140 to capture the tab 138 for movement with the calibration screw. An elongated slot 142 in wall 80 increases flexibility for effective calibration adjustment for positioning the temperature responsive assembly 21 and the actuator 60 relative to the snap spring 42.

Switch frame 20 includes a pair of spaced apart, threaded apertures 148 formed in the side wall 86 used for mounting the thermostat 10 in conventional manner.

Having reference to FIGS. 1, 4, 9, 11, 12A, 12B and 12C, self cleaning temperature calibration mechanism 29 includes a calibration set screw 150 received for adjustable movement through a corresponding threaded aperture 152 within a collar portion 154 of the spindle shaft 102 adjacent the switch frame 20. A generally L-shaped bracket 156 includes an aperture 158 positioned and supported by a stud or post 160 defined by base 16. Bracket 156 provides a stop for the clockwise rotation of the spindle shaft 102 and acts as a wear plate to avoid damage to base 16. Selective adjustment of the calibration set screw 150 positions the actuator 52 relative to the snap spring 42 to accurately control a self cleaning temperature for the electric/gas oven. The calibration set screw 150 is selectively adjusted to control a self cleaning temperature for the electric/gas oven, for example, in a range between 700° F. and 1000° F.

Figure 11:
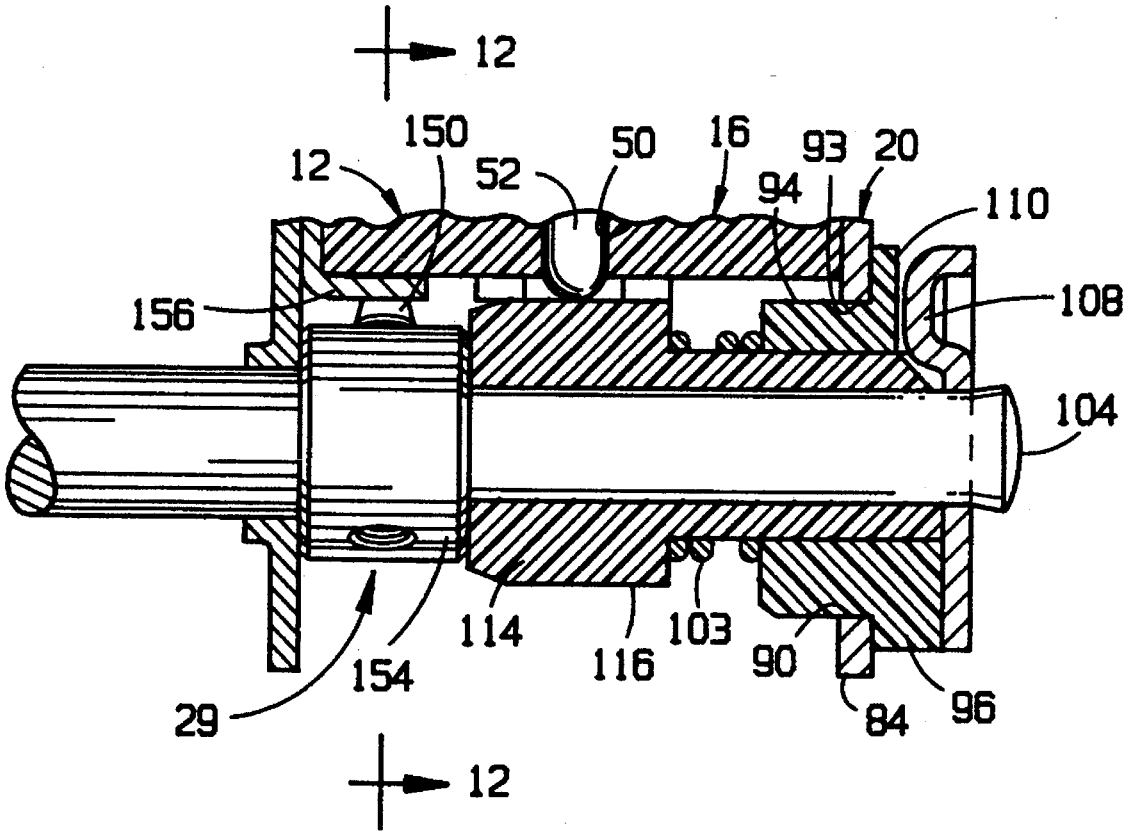
FIG. 11 is an enlarged fragmentary cross-sectional view taken along the line 11—11 of FIG. 4.
Figure 12A:
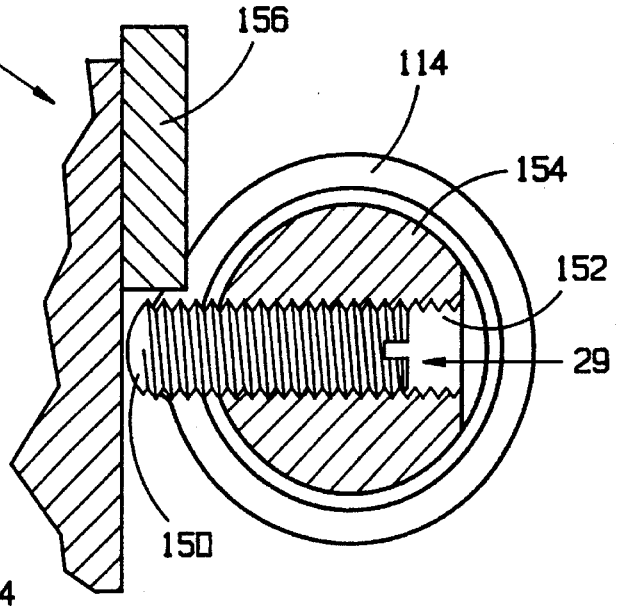
FIGS. 12A, 12B and 12C are enlarged fragmentary cross-sectional views taken along the line 12—12 of FIG. 11 illustrating an OFF position, a maximum calibration self cleaning temperature adjustment and a minimum calibration self cleaning temperature adjustment, respectively.
Figure 12B:
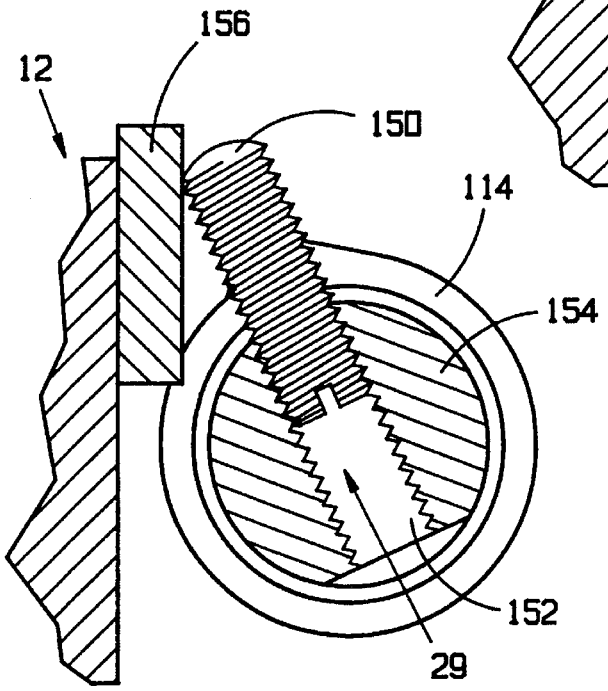
Figure 12C:
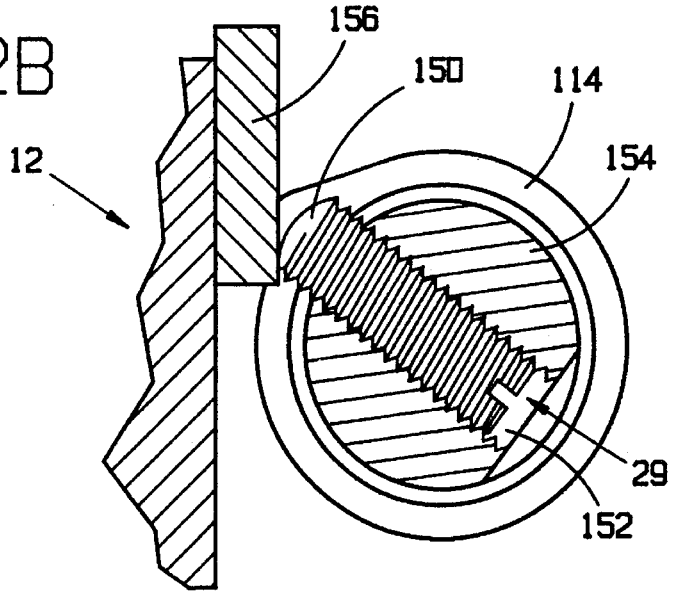

FIGS. 12A, 12B and 12C are enlarged fragmentary cross-sectional views taken along the line 12—12 of FIG. 11 to illustrate the operation of the self cleaning temperature calibration mechanism 29. In FIG. 12A, the electric/gas oven thermostat 10 is shown in an OFF position where the self cleaning temperature calibration mechanism 29 provides a safety stop function. As can be seen in FIG. 12A, counterclockwise rotation past the OFF position of the spindle is prevented by the cooperating engagement of the calibration set screw 150 and the bracket 156. In FIGS. 12B and 12C, thermostat 10 is shown in a self cleaning position.

In FIG. 12B, the illustrated adjustment of the calibration set screw 150 provides a maximum calibration self cleaning temperature, such as 1000° F. In FIG. 12C, the illustrated adjustment of the calibration set screw 150 provides a minimum calibration self cleaning temperature, such as 700° F. It can be seen by comparing FIG. 12B and 12C, calibration set screw 150 is selectively adjusted to set a maximum rotation of the spindle shaft 102 and the corresponding self cleaning temperature calibration.

The calibration set screw 150 is formed, for example, of a low carbon steel. L-shaped stop bracket 156 is formed of sheet metal that is punched or stamped and formed as shown.

While the present invention has been described with reference to the details of the embodiments of the invention shown in the drawing, these details are not intended to limit the scope of the invention as claimed in the appended claims.

What is claimed is:

1. A thermostat for use with an oven of an electric or gas range comprising:

a first electrical contact;

a second electrical contact;

a switch spring arm for moving the electrical contacts into and out of engagement;

a pair of actuators for coupling forces to said switch spring arm;

an enclosure for enclosing said switch spring arm and said first and second electrical contacts, said enclosure having axially aligned channels extending through opposed walls for slidably receiving said actuators;

a temperature responsive subassembly including means for movement responsive to changes in oven temperature;

a spindle subassembly including means for movement responsive to manual rotation of a spindle;

a frame for supporting said enclosure and for supporting both said temperature responsive subassembly and said spindle subassembly in operative position with respect to said actuators; and self cleaning temperature calibration means for selecting a self cleaning oven temperature setting; said self cleaning temperature calibration means comprising cooperating means coupled to said spindle and said enclosure; wherein said cooperating means coupled to said spindle and said enclosure include a calibration set screw received for adjustable movement through a corresponding threaded aperture within said spindle.

2. A thermostat as recited in claim 1 wherein said cooperating means coupled to said spindle and said enclosure include a bracket carried by said enclosure.

3. A thermostat for use with an oven of an electric or gas range comprising:

a first electrical contact;

a second electrical contact;

a switch spring arm for moving the electrical contacts into and out of engagement;

a pair of actuators for coupling forces to said switch spring arm;

an enclosure for enclosing said switch spring arm and said first and second electrical contacts, said enclosure having axially aligned channels extending through opposed walls for slidably receiving said actuators;

a temperature responsive subassembly including means for movement responsive to changes in oven temperature;

a spindle subassembly including means for movement responsive to manual rotation of a spindle;

a frame for supporting said enclosure and for supporting both said temperature responsive subassembly and said spindle subassembly in operative position with respect to said actuators; and self cleaning temperature calibration means for selecting a self cleaning oven temperature setting; said self cleaning temperature calibration means comprising cooperating means coupled to said spindle and said enclosure; wherein said cooperating means coupled to said spindle and said enclosure include an adjustable member carried by said spindle and a stop member carried by said enclosure.

4. A thermostat as recited in claim 3 wherein said stop member is mounted and positioned by said enclosure relative to said adjustable member.

5. A thermostat as recited in claim 3 wherein adjustable member and said stop member are arranged to limit rotation of said spindle.

6. A thermostat as recited in claim 3 wherein adjustable member is selectively adjusted to control the self cleaning oven temperature.

7. A thermostat as recited in claim 3 wherein said cooperating means are operatively arranged for relative positioning to limit rotation of said spindle.

8. A thermostat as recited in claim 1 wherein said cooperating means include a generally L-shaped stop member carried by said enclosure.

9. A thermostat as recited in claim 8 wherein said generally L-shaped stop member is a stamped and formed sheet metal member.

10. A thermostat as recited in claim 8 wherein said self cleaning temperature calibration means for selecting a self cleaning oven temperature setting is selectively arranged to provide the self cleaning oven temperature setting in a range between 700° F. and 1000° F.

11. A thermostat as recited in claim 8 wherein said generally L-shaped stop member is positioned and supported by a post defined by said enclosure.

* * * * *